US005515573A

United States Patent [19]

Frey

[11] Patent Number: 5,515,573

[45] Date of Patent: May 14, 1996

[54] VACUUM CLEANER CANISTER BASE CONNECTOR

[75] Inventor: Robert A. Frey, Westlake, Ohio

[73] Assignee: HMI Industries Inc., Cleveland, Ohio

[21] Appl. No.: 224,693

[22] Filed: Apr. 8, 1994

[51] Int. Cl.[6] ..... A47L 5/36

[52] U.S. Cl. ..... 15/327.2; 15/323; 15/327.6; 15/339; 248/205.2

[58] Field of Search ..... 15/327.2, 327.1, 15/339, 323; 280/79.5; 248/205.2

[56] References Cited

U.S. PATENT DOCUMENTS

| | | | |
|---|---|---|---|
| 2,779,432 | 1/1957 | Meyerhoefer | 15/323 X |
| 2,862,220 | 12/1958 | Orr | 280/79.5 X |
| 3,358,316 | 12/1967 | Okun | 15/327.6 X |
| 4,342,131 | 8/1982 | Reid | 15/327.6 |
| 4,355,434 | 10/1982 | Gongwer | 15/327.1 |
| 4,831,682 | 5/1989 | White | 15/325 X |
| 5,065,922 | 11/1991 | Harris | 248/205.2 X |
| 5,248,323 | 9/1993 | Stevenson | 95/90 |
| 5,309,600 | 5/1994 | Weaver et al. | 15/323 X |

*Primary Examiner*—Chris K. Moore
*Attorney, Agent, or Firm*—Vickers, Daniels & Young

[57] ABSTRACT

A vacuum cleaner is provided comprising a canister including a chamber with an air inlet, an electric motor and a fan driven by the motor. The fan creates a vacuum in the chamber drawing air in a path from an air inlet through a filter located in the chamber, and out an air outlet. The vacuum cleaner includes a platform base, the base being detachable from the canister by a VELCRO fastening system.

11 Claims, 3 Drawing Sheets

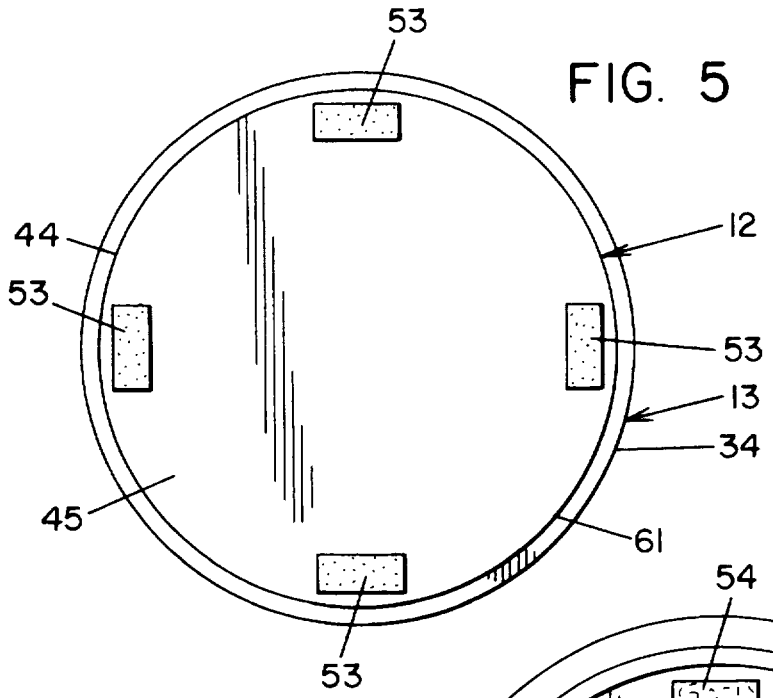
FIG. 5
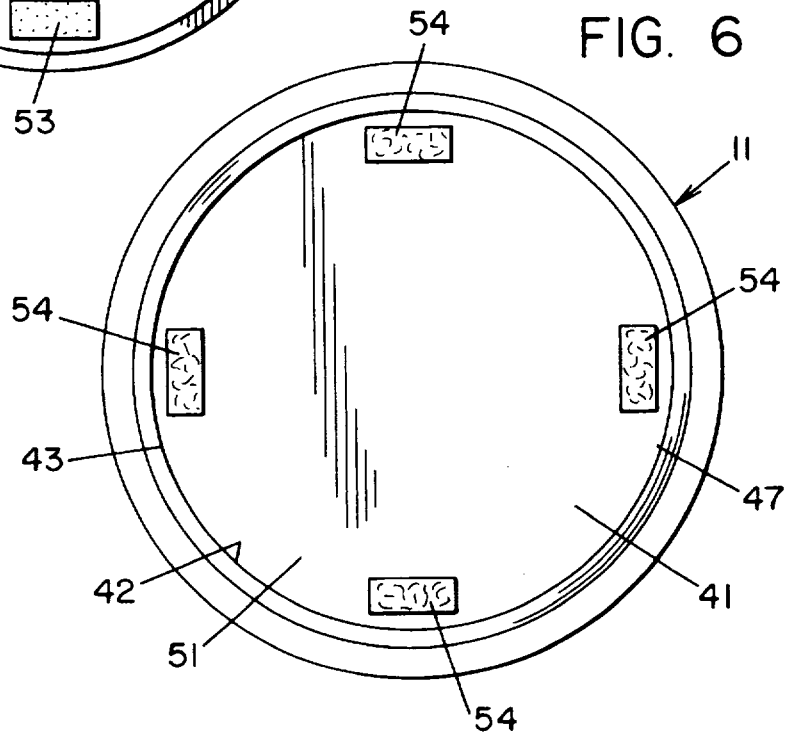
FIG. 6
FIG. 7
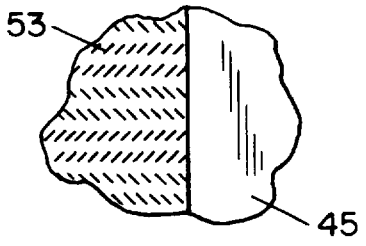
FIG. 8
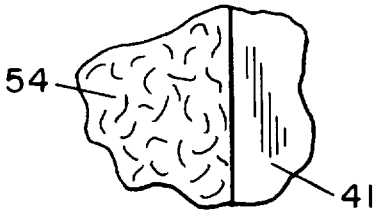

VACUUM CLEANER CANISTER BASE CONNECTOR

The present invention relates to the art of vacuum cleaners and more particularly to an improved vacuum cleaner canister platform connection.

The invention is particularly applicable to a canister type vacuum cleaner and it will be described with particular reference thereto; however, it will be appreciated that the invention is applicable to any type of vacuum cleaner in which separate portions are detachably secured.

INCORPORATION BY REFERENCE

Stevenson U.S. Pat. No. 5,248,323 is incorporated by reference herein so that background vacuum cleaners known in the art need not be described in detail hereinafter.

BACKGROUND OF THE INVENTION

A canister type vacuum cleaner is well known in the prior art and generally includes a canister portion, an upper portion to cap the canister and a base or platform portion upon which the canister rests and is thereby capable of movement. The base portion generally includes rollers, casters or wheels located at three, four or more points on the outer perimeter of the platform. Each caster or wheel is capable of swiveling through 360° in order that the vacuum may be pulled in any direction and thereby roll in that direction. Canister vacuums are useful in any environment. However, canister vacuums are particularly applicable to areas in which standard upright vacuums, well known to those in the prior art, cannot reach. Such areas include small confined areas where a standard upright cleaner will not fit or cannot access, such as in corners or on stairs. Additionally, canister vacuums generally are capable of creating greater vacuum pressure in order that larger particulate matter may be removed from a vacuumed surface. Thus, a canister type vacuum cleaner presents many advantages over other available vacuum cleaners known in the prior art.

A canister type vacuum cleaner, as discussed above generally is comprised of three separate sections, the base, the canister portion with the filter therein, and a cover portion. Cover portions generally includes a fan and a motor for driving the fan in order that vacuum pressure is created within the canister. The cover also forms an enclosed cylinder when placed upon the canister. The canister is generally a cylinder having a flat bottom with a filter placed therein. When the filter becomes clogged through use and/or the canister becomes filled with particulate matter, the cover is removed, the filter is cleaned and/or replaced and the canister is emptied. Thus, the vacuum is again available for use and optimum vacuum pressure is restored.

Certain vacuums in the prior art include a cover, canister and base optimally held together by means of straps running generally parallel to the central axis of the canister. The straps are fastened by means of clamps, buckles or snaps or any other means known in the prior art. Thus, when completely assembled, the canister vacuum has a cover and a platform base with the canister interposed therebetween. This presents problems when it is desired to remove the cover to replace the filter or empty the canister. When the clamps are undone, the straps are unfastened and the cover is removed, the base is also removed from the canister. When it is time to reassemble the three parts, the canister must be placed on the base and the cover must be aligned with points on the base in order that the straps may be placed in their correct location. This can be time consuming, tedious and frustrating to any vacuum operator.

Other canister vacuums in the prior art also include three parts; a cover, canister and base in which the cover is connected to the canister by one set of fasteners, while the canister is connected to the base by a different set of fasteners. With such arrangement, the platform base may be removed and the vacuum may still be operated without the base. However, the fasteners between the canister and the base of these prior art vacuums are difficult for a vacuum operator to use. They require the vacuum operator to stoop over low to the ground to fasten or unfasten, as well as requiring alignment between points on the canister and points on the base before the fasteners can be latched. This disadvantage is both time consuming and tedious. In order to avoid the above disadvantages, three part canister vacuums have also been constructed with a cover connected to the canister with fasteners and a separate base, upon which the canister is placed. There are no fasteners provided to keep the canister on the base. Instead the base is provided with a depressed receptacle within which the canister is placed. A circumferential lip on the platform base prevents the canister from sliding off the base. Thus, the vacuum is moved about the floor using rollers on the platform base by pulling on the vacuum hose. However, there are also distinct disadvantages in this design. For instance, the vacuum cannot be picked up as a unit, since, in attempting to do so, the base will fall off. However, even when the vacuum is being pulled around using the hose, the vacuum tends to come apart since it often turns over upon hitting the edge of a rug or some other obstruction on the floor.

In order to solve prior art problems, it has been suggested in the prior art to provide a canister type vacuum cleaner having only two parts, a cover, including the motor and fan unit for creating vacuum pressure, and a canister having an integral or homogeneous base or platform unit provided with casters or wheels in order to allow movement of the canister from place to place during operation. Thus, when it becomes necessary to empty the canister or change the filter, the cover, provided with any of a number of known clamps, snaps or buckle fasteners is removed allowing the canister to be accessed and emptied. Because the base is an integral part of the canister, placing the cover on the canister is easy and no longer time consuming. However, in certain instances a canister type vacuum cleaner with its versatility and high vacuum pressure is desired to be used in areas where a base having wheels or casters is a detriment or adds unnecessary weight. Such areas may include a sloped surface, where it is desired that the canister remain stationary, as in outdoor applications, or in high areas which are hard to reach and in which the canister must be lifted off of the ground due to the length limitations of the vacuum hose, i.e. vacuuming draperies or vacuuming stairs or carpeted stairs where the canister needs to be carried along the stairs.

Canister vacuums are especially useful on stairs, where the vacuum hose and wand portion can access every corner for efficient cleaning. However, prior art canister type vacuum cleaners are virtually impossible to use on stairs without the operator carrying the full weight of the canister along the stairs. This requires the vacuum operator to perform unnecessary work. Prior art canister type vacuum cleaners having an integral base with wheels or casters will not stay on the stairs, as these type vacuum cleaners have the tendency to roll off of the stairs. Prior art canister type vacuum cleaners in which the base and cover are separable parts having common straps connecting them to the canister are also not adequate for stair or similar vacuum operations.

In those prior art vacuums, the base can only be removed upon removal of the straps which also hold the cover in place over the top of the canister. Thus, the base of the vacuum cannot be removed without disassembling the entire vacuum assembly, making the canister type vacuum inoperative. Even in those prior art canister vacuums having fasteners between the cover and the canister and either separate fasteners between the base and the canister, or a base on which the canister sits without fasteners, enabling a user to remove the base without removing the cover, the canister type vacuum would still not be able to be placed effectively on a stair. Generally, the size of canister type vacuums is such that when placed on a standard size stair tread, the center of gravity of the vacuum is over the edge of the stair and the canister vacuum will tend to fall off of the stair. Reducing the size of a standard canister vacuum detrimentally reduces the available vacuum pressure.

SUMMARY OF THE INVENTION

The present invention, advantageously provides a canister type vacuum cleaner which overcomes the disadvantages of prior art canister type vacuum cleaners in that a removable platform or base is provided separate from a removable cover and with an improved retaining arrangement by which such removable base is easily assembled and disassembled relative to the canister.

More particularly in this respect, a VELCRO (TM) fastening system is provided for detachably mounting the canister to the base. The VELCRO fastening system includes hook portions and loop portions located on the canister and the base so as to interengage to detachably mount the canister to the platform base.

The present invention solves many of the prior art problems by providing a base which is quickly detachable from the canister in order that free movement of the canister independent of the base can be achieved when desired. The base is easily separated from the canister, by pulling the base and canister apart thereby disengaging the hook portions from the loop portions. Thus, the entire vacuum unit is separable from the base. It is also quickly and easily reattached just by placing it back on the base, the weight of the canister engages the corresponding VELCRO components. This advantageously provides a vacuum unit wherein wheeled mobility can be easily and quickly restricted, by removing the base, attached to the canister or quickly and easily reobtained by setting the canister on the base. Further, such removal is also advantageous since the overall weight of the vacuum unit is reduced by removing the base, allowing the vacuum operator to carry or otherwise hold the vacuum unit in an unsupported position for sustained periods of time without easily tiring. Further, the VELCRO fastening system eliminates the problem in the prior art wherein an operator was required to disengage the base from the canister when the operator desired to open the cover to access and empty the canister or clean or replace the filter. The present fastening system allows that any number of known means may be used between the cover and the canister, such as clamps or buckle fasteners. Thus, one of the distinct problems in the prior art is eliminated, in that the interior of the canister can be accessed without the need to remove the base from the canister. Therefore, the job of cleaning the filter and emptying the canister is easier, less tedious and less time consuming.

In accordance with one aspect of the present invention, the vacuum cleaner canister includes the VELCRO hooks and the base includes the looped fabric component of the VELCRO system. This overcomes disadvantages in the prior art since the canister can be placed on any fabric covered surface containing loops, such as furniture or carpeted stair treads, and be relatively fixedly attached by the hooks engaging the looped fabric. It is thus possible for a vacuum operator to use the canister vacuum on carpeted stairs without having to carry or hold the weight of the vacuum unit. Instead the vacuum canister is placed on the stair tread, and the VELCRO hooks engage the looped fabric of the carpeting, resulting in the vacuum remaining stationary and fixed the that the VELCRO hooks prevent the vacuum from tilting and falling off of the stair tread. In the same way, the canister vacuum unit may be placed above the floor surface, for example on fabric covered furniture, in order that furniture, or other areas at considerable height above the floor may be vacuumed. Thus, higher areas in a home, such as draperies or ceiling corners may be vacuumed without the necessity of long vacuum hoses or additional extensions and with the canister securely supported. This feature of the present invention advantageously allows the canister to be securely supported directly adjacent any area to be vacuumed, wherever that may be, so long as the canister is placed upon a looped fabric which can interengage with the VELCRO hooks.

It is thus an outstanding object of the invention to provide a canister type vacuum cleaner having a detachable base with a VELCRO type fastening system to detachably mount the base to the canister.

It is yet another object of the invention to provide a canister type vacuum cleaner which permits easier assembly and disassembly between the canister and the base than theretofore possible.

Still another object of the invention is to provide a canister type vacuum cleaner having a detachable base which does not have to be detached from the canister in order to access the interior of the canister.

Yet another object of the invention is to provide a canister type vacuum cleaner which can be detachably secured to a fabric such as carpet.

A further object of the invention is to provide a canister type vacuum cleaner having a base which is easier and less time consuming to disassemble and assemble relative to the canister than other canister type cleaners with a detachable base.

These and other objects of the invention will become apparent to those skilled in the art upon reading and understanding the detailed description in the following section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein:

FIG. 5 is a cross-sectional view taken alone line 5—5 of FIG. 2 showing the bottom of the canister;

FIG. 6 is a cross-sectional view taken along line 6—6 of FIG. 2 showing the platform base;

FIG. 7 is a detailed view of the VELCRO hooks shown in FIG. 5; and

FIG. 8 is a detailed view of the VELCRO loops shown in FIG. 6.

THE PREFERRED EMBODIMENT

Figure 1:
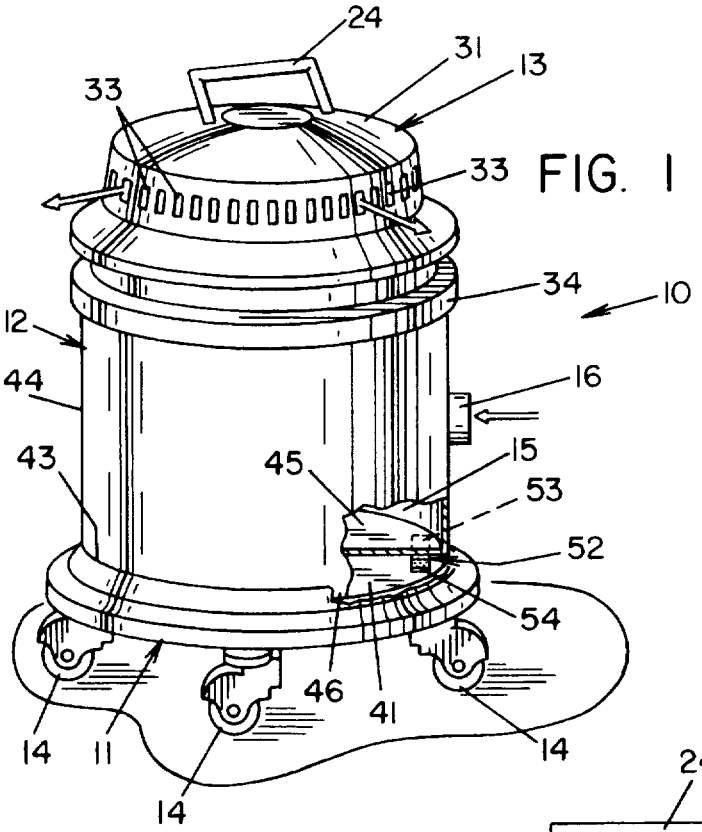
FIG. 1 is a pictoral view partially in section illustrating a canister type vacuum cleaner according to the present invention.
Figure 2:
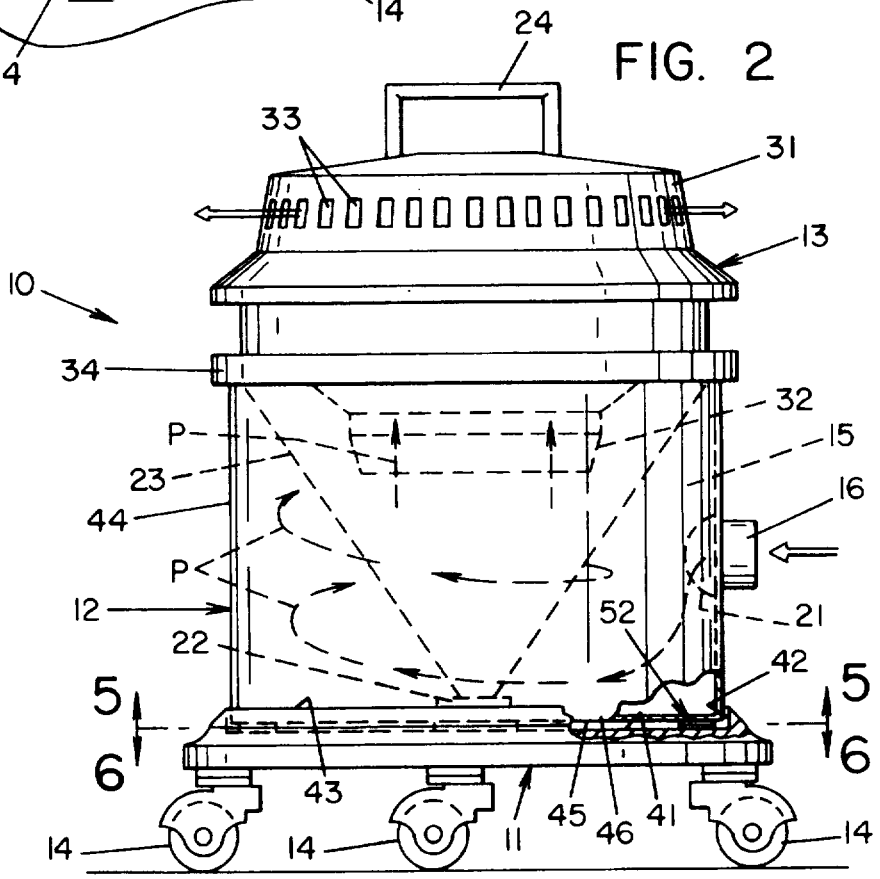
FIG. 2 is an elevation view partially in section of the vacuum cleaner.

Referring to the drawings, wherein the showings are for the purpose of illustrating the preferred embodiment of the invention only and not for the purpose of limiting same, FIGS. 1 and 2 show a canister type vacuum cleaner 10 according to the present invention. Canister type vacuum cleaner 10 includes a platform or base 11, a canister 12 and a cover 13 for canister 12. Canister 12 is generally cylindrically shaped and base 11 is generally disc-shaped for nesting of canister 12 into base 11. In the illustrated embodiment, a plurality of circumferentially spaced wheels or casters 14 support vacuum cleaner 10 for movement on the floor of a room being cleaned. Canister 10 includes a low velocity chamber 15 with a high velocity inlet 16, an air deflector 21 and a lower filter rest 22. Air flow through the vacuum cleaner is illustrated by arrows defining a path P of several convolutions so that particles carried by air through chamber 15 are removed by centrifugal force and are retained in low velocity chamber 15. Thereafter, air flow path P is generally in an upwardly vertical direction so that the air being cleaned moves through a conical filter element or layer 23. Such types of filters and variations thereof are well known in the prior art and will not be discussed in detail herein. As so far described, air passes through conical filter layer or element 23 and upwardly in a direction defined by air path P. Cover 13 includes a motor driven fan housing 31 which includes a lower inlet 32 and an air exhaust shown as a large number of peripherally spaced exhaust openings 33. Within fan housing 31 is an electric motor and a fan driven by the motor, not shown, for creating a vacuum in low velocity chamber 15. When it is desired to empty canister 12 or change filter element 23, cover 13 is removed from canister 12 by unfastening clamps or buckle fasteners (not shown) in the vicinity of housing rim 34 and lifting the cover by handle 24. It will be appreciated that cover 13 may be secured to canister 12 by any one of a number of fastener arrangements known in the art. Once cover 13 is removed, the contents of low velocity chamber 15 may be emptied, filter element 23 replaced if necessary, and cover 13 placed back on canister 12.

Figure 3:
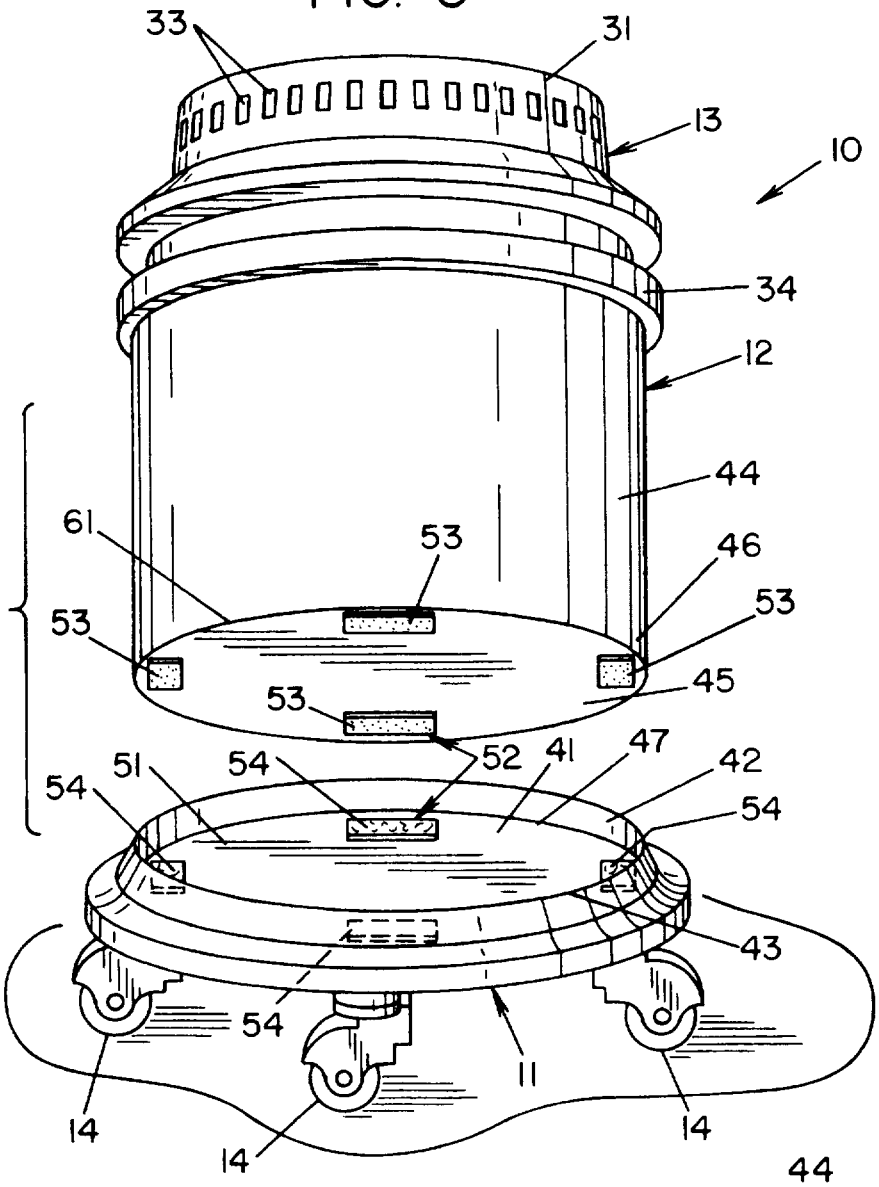
FIG. 3 is a pictoral view of the vacuum cleaner showing the platform base detached from the canister.
Figure 4:
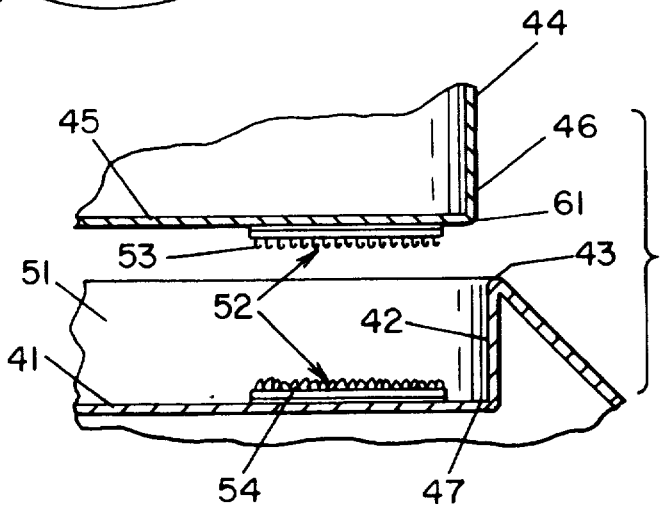
FIG. 4 is an enlarged view in section, showing the VELCRO connection system between the canister and platform base.

Platform base 11, as best shown in FIG. 3, includes a canister supporting plate 41 surrounded by a circumferential lip 42 to form a dish portion 51, which terminates at an upper rim 43. Canister 12, is generally cylindrical in shape and includes an outer wall 44 and a bottom wall 45. It will be appreciated that bottom wall 45 is generally flat and circular in shape having an outer diameter. Canister supporting plate 41 is also generally flat and circular in shape and bounded at its periphery by circumferential lip 42. The diameter of canister supporting plate 41 is generally equal to or slightly greater than bottom wall 45. Thus, when vacuum cleaner 10 is in its assembled position, bottom wall 45 is adjacent canister supporting plate 41 and the lower portion 46 of outer wall 44 is in side-by-side contact with circumferential lip 42 of base 11. Thus, canister 12 is prevented from being sliding off of base 11 by circumferential lip 42.

Canister 12 is prevented from being unintentionally lifted out of dish portion 51 by VELCRO fastening system 52 comprised of hook portions 53 and loop portions 54. Hook portions 53 are designed to interengage with looped fabric and specifically with loop portions 54. It will be appreciated that hook portions 53 are of the type that are capable of grasping any number of known looped or woven fabrics commonly used as carpeting or furniture covering.

In the preferred embodiment shown, small sections of VELCRO hook portions 53 are relatively equally circumferentially spaced along the outer perimeter 61 of bottom wall 45 and suitably secured thereto such as by an adhesive. Complementary loop portions 54 are relatively equally spaced along the lower rim 47 of canister support plate 41 and secured thereto such as by an adhesive. Each hook portion 53 on bottom wall 45 includes a complementary loop portion on canister support plate 41. Thus, when properly aligned, canister 12 may be placed within dish portion 51 of base 11 to engage each hook portion 53 with a complementary loop portion 54 to securely but releasably fasten base 11 to canister 12. When it is desired to remove canister 12 from base 11, gentle pressure is placed upon base 11 while canister 12 is pulled upward, as by grasping handle 24.

In the preferred embodiment shown, there are four hook portions 53 and complementary loop portions 54. It will be appreciated that any number of VELCRO fasteners, depending upon the size of each portion, may be used. Further, it would be possible to have one continuous hook portion running around the outer perimeter 61 of bottom wall 45 with a complementary loop portion 54 adjacent lower rim 47. It will be further appreciated that canister 12 and hook portions 53 need not be perfectly aligned with complementary loop portions 54 in order to obtain the desired connection. It is sufficient that only a portion of hook portions 53 interengage with a portion of loop portions 54.

In the preferred embodiment hook portions 53 are located on bottom wall 45 in order that, when desired, base 11 may be removed and vacuum cleaner 10 may be releasably secured to any looped fabric when placed thereon. Thus, an operator may fix vacuum cleaner 10 to a carpeted stair tread or place vacuum cleaner 10 on an item of furniture as described above without vacuum cleaner 10 either tipping over or otherwise falling off the furniture.

The invention has been described with reference to preferred and alternative embodiments. Obviously, modifications and alterations other than those discussed herein will occur to those skilled in the art upon reading and understanding the invention. For example, VELCRO loop portions may be located on the canister and VELCRO hook portions located on the base. Additionally, the base and canister may each include a plurality of both hook and loop portions. Further, while the VELCRO fastening system is the preferred method of connecting the canister to the platform, it will be appreciated that a separate fastening system, such as one known to one with ordinary skill in the art and described in detail hereinabove, such as clamps, buckles or snaps, may be used instead of the VELCRO system. By additionally providing the canister with VELCRO hook portions, it will still be possible for the canister, with the platform removed, to engage a looped fabric such as a carpet stair tread. It is intended to include all such modifications in so far as they come within the scope of the invention.

Having thus described the invention, it is claimed:

1. In a vacuum cleaner comprising canister means providing a chamber having air inlet and outlet means, means for creating a vacuum air path in said chamber between said inlet and outlet means, and filter means in said chamber intersecting said air path, the improvement comprising velcro fastening means for interengaging with a complementary fabric, said velcro fastening means including at least a first fastening portion, wherein said first fastening portion is located on said canister means for interengaging with said fabric whereby said canister means may be releasably retained to said fabric.

2. The vacuum cleaner of claim 1, wherein said first fastening portion includes velcro hooks and said fabric includes complementary loop portions.

3. In a vacuum cleaner comprising canister means providing a chamber having air inlet and outlet means, means for creating a vacuum air path in said chamber between said inlet and outlet means, and filter means in said chamber intersecting said air path, the improvement comprising said canister means having an exterior surface, and velcro hook means on said exterior surface of said canister means for engaging a looped fabric whereby said canister means may be releasably retained to said looped fabric.

4. The vacuum cleaner of claim 3, wherein said canister includes a side wall and a bottom wall, said velcro hook means located on said bottom wall.

5. The vacuum cleaner of claim 3 including platform means for supporting said canister means, said platform means detachable from said canister means.

6. The vacuum cleaner of claim 5, wherein said velcro hook means is aligned in substantial registry with corresponding velcro loop means for engaging said velcro hook means.

7. The vacuum cleaner of claim 5, wherein said platform means includes wheel means for allowing said vacuum to be rolled across a floor surface.

8. The vacuum cleaner of claim 5, wherein said platform means includes a flat surface and velcro loop means on said flat surface for engaging said velcro hook means.

9. The vacuum cleaner of claim 5, wherein said canister means includes an outer perimeter, said platform means includes a lower rim, said first fastening portion located adjacent said outer perimeter, said second fastening portion located adjacent said lower rim.

10. The vacuum cleaner of claim 5, wherein said platform means includes a recessed portion adapted to receive said canister means.

11. The vacuum cleaner of claim 5, wherein said recessed portion includes a peripheral lip portion extending from said platform means, said canister means including a side wall portion, said peripheral lip portion and said side wall portion adjacent.

* * * * *